US009051933B2

(12) United States Patent
Kirchner et al.

(10) Patent No.: US 9,051,933 B2
(45) Date of Patent: Jun. 9, 2015

(54) VANE PUMP

(75) Inventors: Marco Kirchner, Poppenwind (DE); Michael Langer, Bad Rodach (DE); Christian Richter, Steinbach (DE)

(73) Assignee: Mahle International GmbH (DE)

( * ) Notice: Subject to any disclaimer, the term of this patent is extended or adjusted under 35 U.S.C. 154(b) by 411 days.

(21) Appl. No.: 13/155,041

(22) Filed: Jun. 7, 2011

(65) Prior Publication Data

US 2011/0300015 A1 Dec. 8, 2011

(30) Foreign Application Priority Data

Jun. 8, 2010 (DE) ..... 10 2010 023 068

(51) Int. Cl.

| | |
|---|---|
| ***F01C 1/00*** | (2006.01) |
| ***F04C 2/332*** | (2006.01) |
| ***F01C 21/08*** | (2006.01) |
| ***F04C 15/00*** | (2006.01) |
| *F04C 2/344* | (2006.01) |
| *F04C 14/22* | (2006.01) |

(52) U.S. Cl.

CPC ..... *F04C 2/332* (2013.01); *F01C 21/08* (2013.01); *F04C 2/3441* (2013.01); *F04C 14/226* (2013.01); *F04C 15/0049* (2013.01); *F04C 2240/20* (2013.01); *F04C 2270/13* (2013.01); *F04C 2270/14* (2013.01)

(58) Field of Classification Search

CPC ..... F16N 13/04; F01C 21/08; F04C 2/02; F04C 2/344; F04C 2/3445; F04C 2240/20; F04C 2270/13; F04C 2270/135; F04C 2270/14; F04C 2270/145; F04C 2270/18; F04C 2270/185

USPC ..... 418/5, 24, 1–3, 29, 62, 172–173, 418/176–177, 259; 417/545; 184/26

See application file for complete search history.

(56) References Cited

U.S. PATENT DOCUMENTS

| | | | | | |
|---|---|---|---|---|---|
| 1,210,042 | A | * | 12/1916 | Bullard | 418/138 |
| 1,828,245 | A | * | 10/1931 | Davidson | 418/173 |
| 2,002,827 | A | * | 5/1935 | Morch | 418/173 |
| 2,278,131 | A | * | 3/1942 | Livermore | 418/268 |
| 2,734,461 | A | * | 2/1956 | Porte | 418/138 |
| 2,891,482 | A | * | 6/1959 | Menon | 418/173 |
| 4,125,031 | A | * | 11/1978 | Swain | 74/63 |
| 4,193,748 | A | * | 3/1980 | Swain | 418/173 |

(Continued)

FOREIGN PATENT DOCUMENTS

| | | |
|---|---|---|
| DE | 19532703 C1 | 11/1996 |
| DE | 102007002031 A1 | 7/2008 |

(Continued)

OTHER PUBLICATIONS

Translation of Description DE 102007002031.*

(Continued)

*Primary Examiner* — Kenneth Bomberg
*Assistant Examiner* — Jason T Newton
(74) *Attorney, Agent, or Firm* — Fishman Stewart Yamaguchi PLLC

(57) ABSTRACT

A vane pump is disclosed. The vane pump includes at least an inner rotor and at least one vane. The inner rotor is rotatably mounted in a cage and the at least one vane is configured in at least one substantially radial slot, the slot is configured in the inner rotor, wherein the slots and the vanes are arranged asymmetrically on the inner rotor.

20 Claims, 1 Drawing Sheet

(56) References Cited

U.S. PATENT DOCUMENTS

| | | | | |
|---|---|---|---|---|
| 6,666,671 | B1 * | 12/2003 | Olver et al. | 418/173 |
| 7,438,543 | B2 * | 10/2008 | Beez | 418/172 |
| 7,540,729 | B2 * | 6/2009 | Schneider | 418/173 |
| 7,614,858 | B2 * | 11/2009 | Tanasuca | 418/26 |
| 8,439,650 | B2 * | 5/2013 | Beez et al. | 417/220 |
| 8,801,401 | B2 * | 8/2014 | Yamashita | 417/410.3 |
| 8,858,206 | B2 * | 10/2014 | Richter et al. | 418/173 |
| 2004/0136853 | A1 * | 7/2004 | Clements et al. | 418/24 |
| 2006/0191360 | A1 * | 8/2006 | Beez | 74/25 |
| 2008/0257648 | A1 * | 10/2008 | Lukas et al. | 184/26 |
| 2009/0022612 | A1 * | 1/2009 | Williamson et al. | 418/24 |
| 2009/0269232 | A1 * | 10/2009 | Williamson et al. | 418/24 |
| 2010/0266434 | A1 * | 10/2010 | Beez et al. | 418/24 |
| 2011/0300015 | A1 * | 12/2011 | Kirchner et al. | 418/229 |
| 2012/0082582 | A1 * | 4/2012 | Richter et al. | 418/260 |
| 2012/0148423 | A1 * | 6/2012 | Wagner | 417/311 |
| 2013/0251580 | A1 * | 9/2013 | Maeder et al. | 418/164 |
| 2013/0343940 | A1 * | 12/2013 | Ammon et al. | 418/27 |

FOREIGN PATENT DOCUMENTS

| | | | | |
|---|---|---|---|---|
| DE | 102007002031 | A1 * | 7/2008 | F04C 14/22 |
| EP | 1931879 | A1 | 6/2008 | |

OTHER PUBLICATIONS

Translation of of Description, DE 102007002031 A1, Jun. 6, 2013.*
English abstract for DE-102007002031.
English abstract for DE-19532703.

* cited by examiner

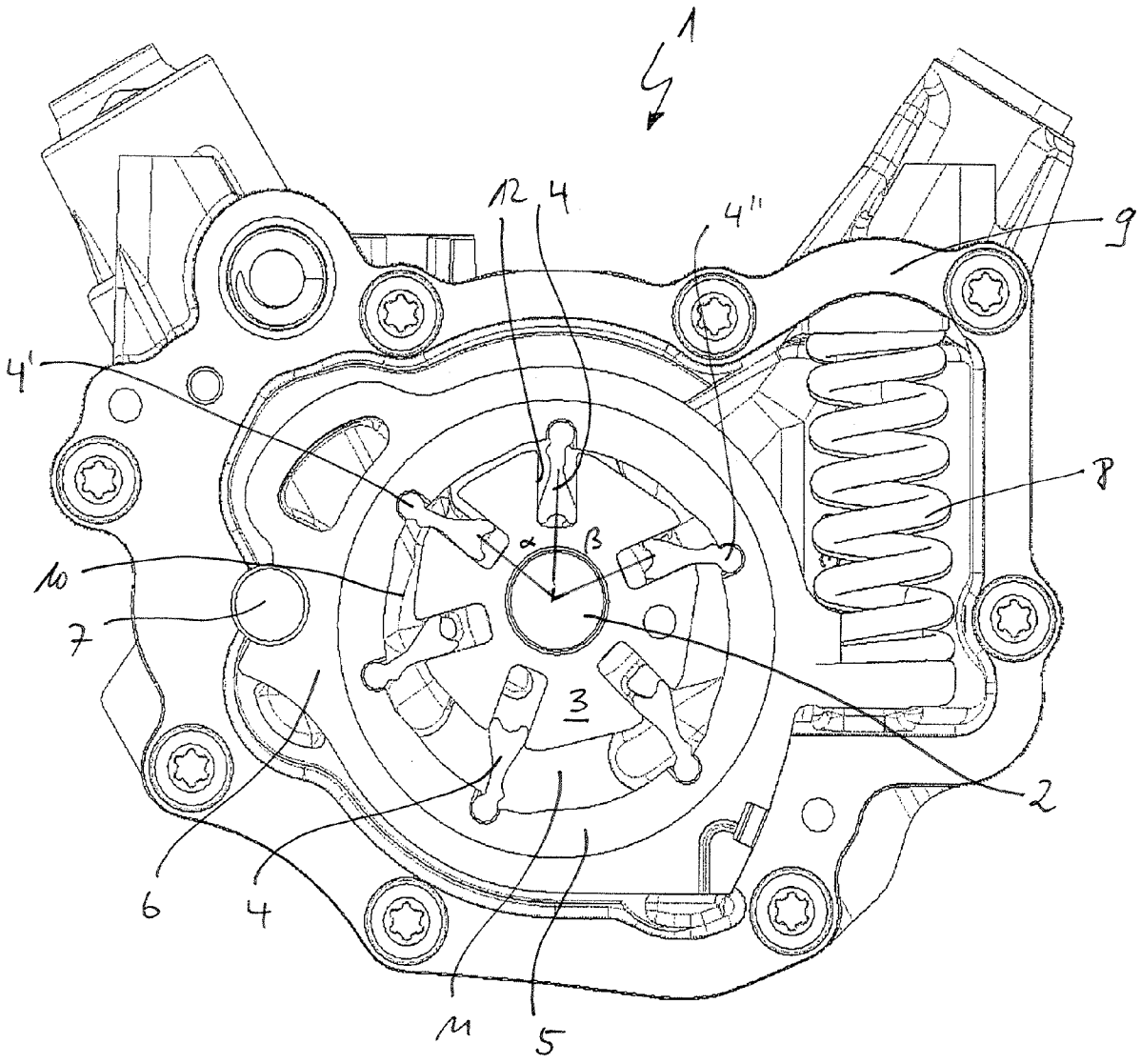
1
9
8
2
4''
4
12
β
α
3
5
11
4
6
10
7
4'

VANE PUMP

CROSS-REFERENCES TO RELATED APPLICATION

This application claims priority to German patent application DE 10 2010 023 068.5 filed on Jun. 8, 2010, which is hereby incorporated by reference in its entirety.

TECHNICAL FIELD

The present invention relates to a vane pump, in particular for supplying an internal combustion engine with lubricant, for example oil.

BACKGROUND

The use of flow rate-controlled vane pumps for internal combustion engines has long been known from the prior art, for example to be able to easily adapt a delivery rate and a pressure to the demand of the internal combustion engine. Such an adaptation takes place in most cases by pressurizing a slider within the vane pump with an oil pressure coming from the main oil gallery of the internal combustion engine.

From DE 195 32 703 C1, a generic vane pump for supplying an internal combustion engine with lubricant, in particular oil, is known, the vane pump comprising an inner rotor and an displaceable outer rotor which rotates along via a pendulum driver. For the rotational driving connection from the inner rotor to the eccentrically displaceable outer rotor, there is always only one pendulum driver with its driver head, driver leg and only one sliding flank in a sliding contact. For controlling the delivery rate, the outer rotor is displaced.

A further vane pump is known, for example, from EP 1 931 879 B1.

The disadvantage of the vane pumps known from the prior art is in particular that the running smoothness during operation is not optimal and associated therewith are vibrations and undesirable noise generation.

SUMMARY

The present invention is concerned with the problem to provide for a vane pump of the generic type, an improved or at least an alternative embodiment which is in particular characterized by a higher running smoothness and therefore a quieter operation.

This problem is solved according to the invention by the subject matter of the independent claim 1. Advantageous embodiments are subject matter of the dependent claims.

The present invention is based on the general idea to achieve, in case of a vane pump known per se for supplying an internal combustion engine with lubricant, in particular with oil, an energy scattering with respect to pulsations, structure-borne sound and airborne sound by dividing the energy not only into pump main orders but also pump secondary orders. For this, the vane pump according to the invention has an inner rotor which is rotatably mounted in a cage (outer rotor) and has a plurality of vanes which are mounted in a radially displaceable manner in substantially radial slots in the inner rotor. According to the invention, these slots and therefore also vanes themselves are arranged asymmetrically on the inner rotor, whereby in particular pressure peaks, pulsations can be scattered and thus divided into different orders. The asymmetrical arrangement of the slots and therefore also the asymmetrical arrangement of the vanes on the inner rotor, moreover, offers also structural advantages because in particular the forces resulting from a torque are irregularly transmitted into the structures of the vane pump and thereby, vibration effects can be prevented or at least reduced. Through the asymmetrical arrangement of the vanes on the inner rotor, thus, a significantly increased running smoothness can be achieved which makes in particular the operation of the vane pump significantly quieter.

In an advantageous further development of the solution according to the invention, at least one vane has a larger circumferential distance to its one neighbor than to its other neighbor. An asymmetrical arrangement of the individual vanes can be implemented, for example, in that one or more vanes have a closer distance to each other than to other vanes so that the vanes enclose different angles with each other in the circumferential direction. When providing for example six vanes, for example three vanes can be arranged at an angle of 58° in each case and three further vanes can be arranged at an angular distance of approximately 62° to each other, whereby the asymmetrical arrangement according to the invention can be achieved. In case of a vane pump having a total of six chambers, that is having six vanes, thus, there are three main orders, namely 6, 12 and 18, wherein in case of the asymmetrical arrangement of these vanes, in addition, the respective secondary orders +/−1 can be energetically increased, thus e.g. 5, 7 in case of the main order 6 and 11, 13 in case of the main order 12 and, at the same time, the mentioned main orders can be slightly decreased. The energetic scattering is in particular noticeable through an increased running smoothness and a lower tendency to vibrate.

Further important features and advantages of the invention arise from the sub-claims, from the drawings, and from the associated description of the FIGURES based on the drawings.

It is to be understood that the above mentioned features and the features yet to be explained hereinafter can be used not only in the respectively mentioned combination but also in other combinations or alone without departing from the context of the present invention.

A preferred exemplary embodiment of the invention is illustrated in the drawing and is explained in the following description in more detail.

BRIEF DESCRIPTION OF THE DRAWING

The sole FIG. 1 shows a sectional view through a vane pump according to the invention.

DETAILED DESCRIPTION

According to FIG. 1, a vane pump 1 according to the invention which, in this case, is configured as pendulum-slider pump, has a shaft 2 on which an inner rotor 3 is arranged in a rotationally fixed manner. The inner rotor 3 is operatively connected via individual vanes 4 which in this case are formed as pendulums 4, to a cage 5 which has the function of an outer rotor. The cage 5 itself is retained in a slider 6 and is pivotable via said slider 6 about a bearing pin 7. A spring 8 generates a pretension of the slider 6 in a predefined direction. The spring 8, for example a control spring, is supported on one end on the slider 6 and on the other end on a spring abutment on the housing 9. By rotating the slider 6 about the bearing pin 7, a delivery rate of the vane pump 1 according to the invention can be controlled, for example by changing the volumes of a pressure chamber 10 and a suction chamber 11 by a change of the eccentricity of the inner rotor 3 with respect to the slider 6. The vane pump 1 illustrated according to FIG. 1 is configured here as pendulum-slider pump.

The vanes/pendulums 4 are mounted in a radially displaceable manner in substantially radial slots 12 in the inner rotor 3, wherein the slots 12 and therefore also the vanes 4 or, respectively, the pendulums 4, are arranged asymmetrically on the inner rotor 3. Asymmetrical means here that, for example, an angle α between two adjacent pendulums 4 or two adjacent slots 12 is smaller than an angle β between two other directly adjacent slots 12. In this case, the vane 4 has a smaller distance in the circumferential direction from its one neighbor, that is, from vane 4', than from its adjacent vane 4" seen in the other direction.

The vanes 4 configured as pendulums are pivotably mounted on the cage 5 enclosing the inner rotor 3. The vane pump 1 illustrated according to FIG. 1 and configured as pendulum-slider pump has a total of six vanes 4 or six pendulums 4, wherein, of course, more or fewer pendulums are also conceivable. A further asymmetrical arrangement of the slots 12 or vanes 4 can be achieved, for example, in that the slots 12 on the inner rotor 3 and thus also the vanes 4 or the pendulums 4 have different dimensions, for example different thicknesses.

Due to the irregular angular distribution of the vanes 4 or the slots 12, system-related volume flow fluctuations and pressure fluctuations occurring in case of displacement pumps are emitted in irregular time intervals which, with respect to the pulsations (pressure peaks), causes a scattering in different orders. In particular with respect to pulsation, structure-borne sound and airborne sound, such a scattering of energy can result in advantages because besides the weaker pump main orders, which correspond substantially to the number of vanes of the vane pump 1, the secondary order absorbs energy as well. Thus, in case of the vane pump 1 illustrated according to FIG. 1 which, for example, has the main orders 6, 12 and 18, the latter can be energetically decreased and, in addition, the respective secondary orders +/−1 can be increased, thus, e.g., in case of the main order 6, the secondary orders 5 and 7 and in case of the main order 12, the secondary orders 11 and 13. This can also result in structural advantages on the rotor set itself, that is, in particular on the inner rotor 3, because the forces resulting from the torque are irregularly transmitted into the structures, in particular into the housing 9 and thereby, vibration effects can be prevented or at least reduced.

The invention claimed is:

1. A vane pump, comprising:

an inner rotor rotatably mounted in a cage; and a plurality of vanes which are mounted in a radially displaceable manner in substantially radial slots in the inner rotor, wherein the substantially radial slots and the plurality of vanes are arranged asymmetrically on the inner rotor relative to at least one of a vertical and horizontal axis;

wherein at least one of the plurality of vanes has a larger circumferential distance from a first adjacent of the plurality of vanes than from a second adjacent of the plurality of vanes; and wherein the vane pump is configured as a pendulum-slider pump such that the plurality of vanes are configured as pendulums and the substantially radial slots in the inner rotor are sized to permit the plurality of vanes to rotate and slide within the substantially radial slots.

2. The vane pump according to claim 1, wherein the width of the substantially radial slots in the inner rotor is substantially equal.

3. The vane pump according to claim 1, wherein the plurality of vanes are pivotably mounted on the cage, which encloses the inner rotor.

4. The vane pump according to claim 1, wherein the plurality of vanes is at least six vanes.

5. The vane pump according to claim 1, wherein at least one of the substantially radial slots on the inner rotor have different dimensions.

6. The vane pump according to claim 1, further comprising a slider, which receives the cage and the inner rotor, wherein the slider is pretensioned by a spring, the spring controls a delivery rate of the vane pump.

7. A pendulum-slider vane pump, comprising:

an inner rotor rotatably mounted in a cage; and at least two vanes configured in at least two substantially radial slots, the at least two substantially radial slots configured in the inner rotor, wherein the at least two substantially radial slots and the at least two vanes are arranged asymmetrically on the inner rotor relative to at least one of a vertical and horizontal axis; and wherein the at least two vanes are configured as pendulums and the at least two substantially radial slots in the inner rotor are sized to permit the vanes to rotate and slide within the at least two substantially radial slots.

8. The pendulum-slider vane pump according to claim 7, wherein at least one vane of the at least two vanes has a larger circumferential distance from a first adjacent vane than the at least one vane of the at least two vanes has from a second adjacent vane.

9. The pendulum-slider vane pump according to claim 7, wherein at least one vane of the at least two vanes is pivotably mounted on the cage, which encloses the inner rotor.

10. The pendulum-slider vane pump according to claim 7, wherein the at least two vanes is at least one of six vanes.

11. The pendulum-slider vane pump according to claim 7, wherein at least one of the at least two substantially radial slots on the inner rotor and at least one of the at least two vanes have different dimensions.

12. The pendulum-slider vane pump according to claim 7, further comprising a slider, which receives the cage and the inner rotor, wherein the slider is pretensioned by a spring, the spring controls a delivery rate of the pendulum-slider vane pump.

13. A vane pump, comprising:

an inner rotor rotatably mounted in a cage; and at least two vanes configured in at least two substantially radial slots, the at least two substantially radial slots configured in the inner rotor, wherein the at least two substantially radial slots and the at least two vanes are arranged asymmetrically on the inner rotor relative to at least one of a vertical and horizontal axis;

wherein the at least two vanes are configured as pendulums and the at least two substantially radial slots in the inner rotor are sized to permit the at least two vanes to rotate and slide within the at least two substantially radial slots; and a slider, which receives the cage and the inner rotor, wherein the slider is pretensioned by a spring, the spring controls a delivery rate of the vane pump.

14. The vane pump according to claim 13, wherein at least one vane has a larger circumferential distance from a first adjacent vane than from a second adjacent vane.

15. The vane pump according to claim 13, wherein the width of each slot of the at least two substantially radial slots is substantially equivalent.

16. The vane pump according to claim 13, wherein the at least two vanes are pivotably mounted on the cage, which encloses the inner rotor.

17. The vane pump according to claim 13, wherein the at least two vanes is at least one of six vanes.

18. The vane pump according to claim 13, wherein at least one of the at least two substantially radial slots on the inner rotor and at least one of the at least two vanes have different dimensions.

19. The vane pump according to claim 1, wherein the substantially radial slots and the plurality of vanes are arranged at least one of rotationally asymmetric and reflectionally asymmetric.

20. The pendulum-slider vane pump according to claim 7, wherein the at least two substantially radial slots and the at least two vanes are arranged at least one of rotationally asymmetric and reflectionally asymmetric.

* * * * *